US010479554B2

(12) United States Patent
Dziaba et al.

(10) Patent No.: US 10,479,554 B2
(45) Date of Patent: Nov. 19, 2019

(54) CONTAINER AND LID

(71) Applicant: Kraft Foods Group Brands LLC, Northfield, IL (US)

(72) Inventors: Michele M. Dziaba, Mundelein, IL (US); Andrew Thomas Tilton, Grand Rapids, MI (US); Jeffrey A. Johnson, Lake Forest, IL (US); Joseph M. Miskovic, Bonita Springs, FL (US)

(73) Assignee: Kraft Foods Group Brands LLC, Chicago, IL (US)

( * ) Notice: Subject to any disclaimer, the term of this patent is extended or adjusted under 35 U.S.C. 154(b) by 307 days.

(21) Appl. No.: 14/917,151

(22) PCT Filed: Sep. 8, 2014

(86) PCT No.: PCT/US2014/054476
§ 371 (c)(1),
(2) Date: Mar. 7, 2016

(87) PCT Pub. No.: WO2015/035276
PCT Pub. Date: Mar. 12, 2015

(65) Prior Publication Data

US 2016/0194112 A1 Jul. 7, 2016

Related U.S. Application Data

(60) Provisional application No. 61/875,595, filed on Sep. 9, 2013.

(51) Int. Cl.
*B65D 43/02* (2006.01)
*B65D 21/02* (2006.01)

(52) U.S. Cl.
CPC ..... *B65D 21/0219* (2013.01); *B65D 43/0204* (2013.01); *B65D 2543/00027* (2013.01); *B65D 2543/00398* (2013.01)

(58) Field of Classification Search
CPC ..... B65D 21/0219; B65D 43/0204; B65D 21/0233; B65D 2543/00027; B65D 2543/00083; B65D 2543/00101
(Continued)

(56) References Cited

U.S. PATENT DOCUMENTS 1,587,167 A 6/1926 Marsden
1,717,974 A 6/1929 Heinrichs
(Continued)

FOREIGN PATENT DOCUMENTS

CA 2280153 8/1998
CA 2444041 10/2002
(Continued)

OTHER PUBLICATIONS

Report from Mintel on Product Descriptions for various baby food packaging; http://www.gnpd.com; 80 pages.

*Primary Examiner* — Andrew T Kirsch
*Assistant Examiner* — Elizabeth J Volz
(74) *Attorney, Agent, or Firm* — Fitch, Even, Tabin & Flannery LLP

(57) ABSTRACT

A container lid (10) is provided herein having structurally reinforcing ribs (50) therein. The ribs (50) increase the strength of the lid across a central region thereof. Specifically, the lid can have an outer perimeter and the ribs can be spaced inwardly from the outer perimeter. The inwardly spaced ribs (50) can provide a distinct look for consumer differentiation. Additionally, the ribs can be arcuate so that they generally follow a curvature of the outer perimeter of the lid. As such, a label region (56) within the lid central region is preserved, while the lid is still strengthened by the ribs.

21 Claims, 11 Drawing Sheets

(58) Field of Classification Search
USPC ..... 206/508, 505, 501, 509, 515; 220/380, 220/651, 4.26, 781
See application file for complete search history.

(56) References Cited

U.S. PATENT DOCUMENTS 2,614,727 A 10/1952 Robinson
2,695,115 A 11/1954 Roop
2,780,259 A 2/1957 Nalle
3,070,257 A 12/1962 Bojanowski
3,301,459 A 1/1967 Gardner
3,338,468 A 8/1967 Wilson
3,362,569 A 1/1968 Geiger
3,376,046 A 4/1968 Kivett
3,384,265 A 5/1968 Frank
3,409,123 A 11/1968 McCormick
3,419,184 A 12/1968 Asenbauer
3,421,654 A 1/1969 Hexel
3,430,803 A 3/1969 Nelson
3,448,888 A 6/1969 Smith
3,474,928 A * 10/1969 Hurtt ..... B65D 21/0219 206/508
3,589,552 A 6/1971 Fitzgerald
3,651,981 A 3/1972 Kinney
3,670,922 A 6/1972 Phillips
3,759,437 A 9/1973 Amberg
3,777,968 A 12/1973 Law
3,903,676 A 9/1975 Kinney
3,904,063 A 9/1975 Hauser
D238,137 S 12/1975 Swett
3,967,731 A 7/1976 Boduch
3,989,142 A 11/1976 Gwilliam
4,061,241 A 12/1977 Retelny
4,082,184 A 4/1978 Hammer
4,111,303 A 9/1978 Compton
4,113,095 A 9/1978 Dietz
4,124,120 A 11/1978 Day
D250,929 S 1/1979 Gerstman
4,234,100 A 11/1980 Chabot
4,286,713 A 9/1981 Marchais
4,341,324 A 7/1982 Ramirez
4,401,225 A 8/1983 Schwaikert
4,420,093 A 12/1983 VonHoldt
D274,030 S 5/1984 Daenen
D276,401 S 11/1984 Daenen
4,494,679 A 1/1985 Cleevely
4,512,493 A 4/1985 VonHoldt
4,542,029 A 9/1985 Caner
D285,906 S 9/1986 Tyler
D286,026 S 10/1986 Rayner
D287,573 S 1/1987 Tyler
4,645,086 A 2/1987 Rosenthal
4,747,510 A 5/1988 Mack
4,787,527 A 11/1988 Monetti
4,832,202 A 5/1989 Newman
D321,456 S 11/1991 Wolff
D330,311 S 10/1992 Narsutis
D330,312 S 10/1992 Narsutis
D336,017 S 6/1993 Smith
5,294,015 A 3/1994 Landis
5,377,861 A * 1/1995 Landis ..... B65D 43/0212 206/508
D360,105 S 7/1995 Doxey
D362,932 S 10/1995 Brightbill
5,542,234 A 8/1996 Wyslotsky
D378,039 S 2/1997 Ferris
D383,671 S 9/1997 Phillips
D388,325 S 12/1997 Tucker
D389,738 S 1/1998 Hlobil
D390,109 S 2/1998 Tucker
D398,812 S 9/1998 Laib
5,839,603 A 11/1998 Smith
D414,650 S 10/1999 Lillelund
D416,797 S 11/1999 Rabe
D418,056 S 12/1999 Johnson
D425,416 S 5/2000 Denham
D429,646 S 8/2000 Goettner
6,170,696 B1 1/2001 Tucker
D438,794 S 3/2001 Miles
6,213,301 B1 4/2001 Landis
6,325,213 B1 12/2001 Landis, II
D459,225 S 6/2002 Baxter
6,467,647 B1 10/2002 Tucker
D467,800 S 12/2002 Chen
D468,201 S 1/2003 Huber
D469,320 S 1/2003 Pettaweebuncha
D476,861 S 7/2003 Zettle
6,651,847 B2 11/2003 Mekata
6,672,473 B2 1/2004 Torniainen
D489,975 S 5/2004 Jackson
D496,272 S 9/2004 Jackson
D502,394 S 3/2005 Jackson
6,889,837 B2 * 5/2005 Soehnlen ..... A23G 9/00 206/459.5
6,910,599 B2 6/2005 Tucker
7,017,775 B2 * 3/2006 Zettle ..... B65D 43/021 206/508
D521,380 S 5/2006 Jackson
D524,605 S 7/2006 Czebiniak
D529,797 S 10/2006 Wilcox
D533,452 S 12/2006 Vogel
D538,642 S 3/2007 Bouveret
D540,039 S 4/2007 vanBeuningen
7,207,457 B2 4/2007 Schwarz
D541,648 S 5/2007 Bennett
D544,790 S 6/2007 Bouveret
D545,134 S 6/2007 Hayes
D547,115 S 7/2007 Bouveret
D547,179 S 7/2007 Bouveret
D548,588 S 8/2007 Bouveret
D549,050 S 8/2007 Spencer
7,261,219 B2 8/2007 Tucker
D563,157 S 3/2008 Bouveret
D564,287 S 3/2008 Bouveret
D568,693 S 5/2008 Furlong
D568,694 S 5/2008 Furlong
D571,200 S 6/2008 Bouveret
D575,994 S 9/2008 Faulon
D584,145 S 1/2009 Young
D585,699 S 2/2009 Furlong
D586,179 S 2/2009 Furlong
D591,591 S 5/2009 Moecks
D594,328 S 6/2009 Shapiro
D595,128 S 6/2009 Bouveret
D606,368 S 12/2009 Wu
D607,315 S 1/2010 George
D610,903 S 3/2010 Shapiro
D613,125 S 4/2010 Sierra
D614,949 S 5/2010 Schmidt
7,726,483 B2 6/2010 Ramanujam
D621,664 S 8/2010 Heiberg
D630,512 S 1/2011 Venier
D630,900 S 1/2011 Samartgis
D630,901 S 1/2011 Samartgis
D630,940 S 1/2011 Shapiro
D631,298 S 1/2011 Samartgis
D631,708 S 2/2011 Smyers
D632,559 S 2/2011 Georgiadis
D638,700 S 5/2011 Bouveret
D638,701 S 5/2011 Shapiro
7,938,286 B2 5/2011 Vogel
7,942,286 B2 5/2011 Shiffer
D639,186 S 6/2011 Shapiro
D639,656 S 6/2011 Shapiro
D640,926 S 7/2011 Turchi
D641,211 S 7/2011 Olivari
D641,628 S 7/2011 Baughman
8,006,863 B2 8/2011 Albrecht
D644,888 S 9/2011 Samartgis
D645,738 S 9/2011 Shiffer
D646,160 S 10/2011 Shiffer
D646,968 S 10/2011 Ortiz
D647,358 S 10/2011 Smyers
D647,397 S 10/2011 Inaba

(56) References Cited

U.S. PATENT DOCUMENTS

| | | | | |
|---|---|---|---|---|
| D649,872 | S | 12/2011 | Bouveret | |
| D649,873 | S | 12/2011 | Bouveret | |
| D650,660 | S | 12/2011 | Shiffer | |
| D650,661 | S | 12/2011 | Shiffer | |
| D650,662 | S | 12/2011 | Shiffer | |
| D650,663 | S | 12/2011 | Shiffer | |
| D651,865 | S | 1/2012 | Smyers | |
| D652,266 | S | 1/2012 | Smyers | |
| D655,605 | S | 3/2012 | Baughman | |
| D656,009 | S | 3/2012 | Ortiz | |
| D656,010 | S | 3/2012 | Ortiz | |
| 8,152,018 | B2 | 4/2012 | Smith | |
| D661,403 | S | 6/2012 | Connelly | |
| D661,543 | S | 6/2012 | Bouveret | |
| 8,205,768 | B2 | 6/2012 | Shiffer | |
| 8,251,242 | B2 | 8/2012 | Vovan | |
| D666,876 | S | 9/2012 | Rusnak | |
| D669,313 | S | 10/2012 | Paladino | |
| 8,286,823 | B2 | 10/2012 | Turvey | |
| 8,322,530 | B2 | 12/2012 | Furlong | |
| D675,518 | S | 2/2013 | Wheaton | |
| D679,991 | S | 4/2013 | Hudson | |
| D682,108 | S | 5/2013 | Berggren | |
| D684,855 | S | 6/2013 | BeVier | |
| D686,072 | S | 7/2013 | Wheaton | |
| 8,528,770 | B2 | 9/2013 | Albrecht | |
| D706,131 | S | 6/2014 | Brooks | |
| 8,851,314 | B2 | 10/2014 | Hudson | |
| D718,983 | S | 12/2014 | Yessin | |
| D720,613 | S | 1/2015 | Dziaba | |
| D748,991 | S | 2/2016 | Cerrato | |
| D760,075 | S | 6/2016 | Irimia | |
| D764,277 | S | 8/2016 | Irimia | |
| D765,503 | S | 9/2016 | Shiffer | |
| D766,079 | S | 9/2016 | Shiffer | |
| D772,701 | S | 11/2016 | Dziaba | |
| D792,221 | S | 7/2017 | Dziaba | |
| 2002/0148845 | A1* | 10/2002 | Zettle | B65D 43/021 220/781 |
| 2004/0118737 | A1* | 6/2004 | Welsh | B65D 21/0222 206/508 |
| 2005/0173287 | A1 | 8/2005 | Smith | |
| 2007/0062948 | A1 | 3/2007 | Albrecht | |
| 2007/0102438 | A1 | 5/2007 | Schwarz | |
| 2007/0119743 | A1 | 5/2007 | Tucker | |
| 2007/0187277 | A1 | 8/2007 | Furlong | |
| 2008/0035641 | A1 | 2/2008 | Foldesi | |
| 2008/0047960 | A1 | 2/2008 | Albrecht | |
| 2008/0210686 | A1 | 9/2008 | Shapiro | |
| 2009/0026203 | A1 | 1/2009 | Selina | |
| 2009/0134168 | A1 | 5/2009 | Morrissette | |
| 2009/0287144 | A1 | 11/2009 | Malkin | |
| 2009/0314780 | A1 | 12/2009 | Selina | |
| 2010/0015293 | A1 | 1/2010 | Shapiro | |
| 2010/0108556 | A1 | 5/2010 | Claffy | |
| 2010/0170824 | A1 | 7/2010 | Ramanujam | |
| 2010/0236966 | A1 | 9/2010 | Luttik | |
| 2011/0174658 | A1 | 7/2011 | Otsubo | |
| 2012/0000920 | A1 | 1/2012 | Anhalt | |
| 2013/0015096 | A1 | 1/2013 | BeVier | |

FOREIGN PATENT DOCUMENTS

| | | |
|---|---|---|
| CA | 99857 | 4/2003 |
| CA | 112115 | 4/2006 |
| CA | 114247 | 5/2007 |
| CA | 110624 | 8/2007 |
| CA | 132857 | 6/2010 |
| CA | 133386 | 7/2010 |
| CA | 2749269 | 8/2010 |
| CA | 134427 | 10/2010 |
| CA | 134871 | 11/2010 |
| CA | 141686 | 11/2011 |
| DE | 3703875 | 8/1988 |
| DE | 4306982 | 9/1994 |
| DE | 29906577 | 7/1999 |
| EP | 0628490 | 12/1992 |
| EP | 0575394 | 12/1993 |
| EP | 0990408 | 9/2003 |

* cited by examiner

CONTAINER AND LID

CROSS-REFERENCE TO RELATED APPLICATIONS

This application is a U.S. national phase application filed under 35 U.S.C. § 371 of International Application PCT/US2014/054476, filed Sep. 8, 2014, designating the United States, which claims the benefit of U.S. Provisional Application No. 61/875,595, filed Sep. 9, 2013, which are hereby incorporated herein by reference in their entireties.

BACKGROUND

Plastic containers can be utilized to store a wide variety of items. One type of plastic container is used in a hot-fill process where heated food contents are deposited into a container base without significant prior cooling. The container can then be hermetically sealed for storage and transportation purposes using a flexible foil cover. Due to the heat of the contents, the foil cover can initially expand outwardly. As the contents cool, however, the foil can contract at least partially into the container base so that it has a concave configuration. Moreover, as the contents cool, a vacuum can develop within the container, which can pull the foil cover inward. A plastic lid can also be removably secured to the container base before or after hermetic sealing. As such, the residual heat from the contents can heat the material of the container base and lid making it softer and more prone to deform and stretch. When another container is stacked an top of the container and, more specifically, onto the container lid before the contents have had a chance to cool, the weight of the stacked container can undesirably stretch and can cause permanent deformation of the container lid, which can detract from consumer appeal.

Furthermore, many tubs have a circular footprint. When circular containers are stacked, it can be difficult to quickly and accurately align the containers in a uniform stack and even more difficult to uniformly align any labeling thereon. This problem can also extend to containers having oval or other shaped footprints where there is no structure for aligning the containers with respect to one another. Haphazard stacking and labeling can also undesirably detract from consumer appeal.

SUMMARY

A container lid is provided herein having structurally reinforcing ribs therein. The ribs increase the strength of the lid across a central region thereof. Specifically, the lid can have an outer perimeter and the ribs can be spaced inwardly from the outer perimeter. The inwardly spaced ribs can provide a distinct look for consumer differentiation. Additionally, the ribs can be arcuate so that they generally follow a curvature of the outer perimeter of the lid. As such, a label region within the lid central region is preserved, while the lid is still strengthened by the ribs.

The lid can further include two features having vertically undulating surfaces, which can be complementary. More specifically, the lid can include a raised region that extends around a perimeter of the lid. The raised region includes side portions having intermediate low portions and legs that curve upwardly therefrom and end portions having intermediate high portions and legs curving downwardly therefrom. Additionally or alternatively, the lid can include a skirt having an undulating bottom edge. Similarly to the raised region, the skirt bottom edge can include side portions having intermediate low portions and legs that curve upwardly therefrom and end portions having intermediate high portions and legs curving downwardly therefrom.

A container base is also provided herein, which can be sized so that the container lid can be received thereon in a closing engagement. The container base, in one embodiment, includes a lower portion having a footprint sized to fit within the label region of the lid. As such, the container base can be stacked upon the lid, such as when two or more assembled containers are stacked on one another. Moreover, in one form, when the lid and base have a generally oval configuration in a horizontal plane, the ribs of the lid can act to retain and prevent the base from rotating when the containers are stacked on one another. This feature advantageously keeps the containers in a uniform stacked orientation and can also provide a uniform display front for labeling or other advertising.

The container base can further include a side wall having side wall portions and end wall portions. Upper and lower shoulders or ribs extend generally horizontally around the base sidewall and define a label region therebetween. The upper and lower shoulders can also have undulating configurations. In one form, the upper shoulder can include side portions having an intermediate low portion and legs curving upwardly therefrom and end portions having an intermediate high portion and legs curving downwardly therefrom. In a generally opposite configuration, the lower shoulder can have side portions having an intermediate high portion and legs curving downwardly therefrom and end portions having an intermediate low portion and legs curving upwardly therefrom.

DETAILED DESCRIPTION

Figure 1:
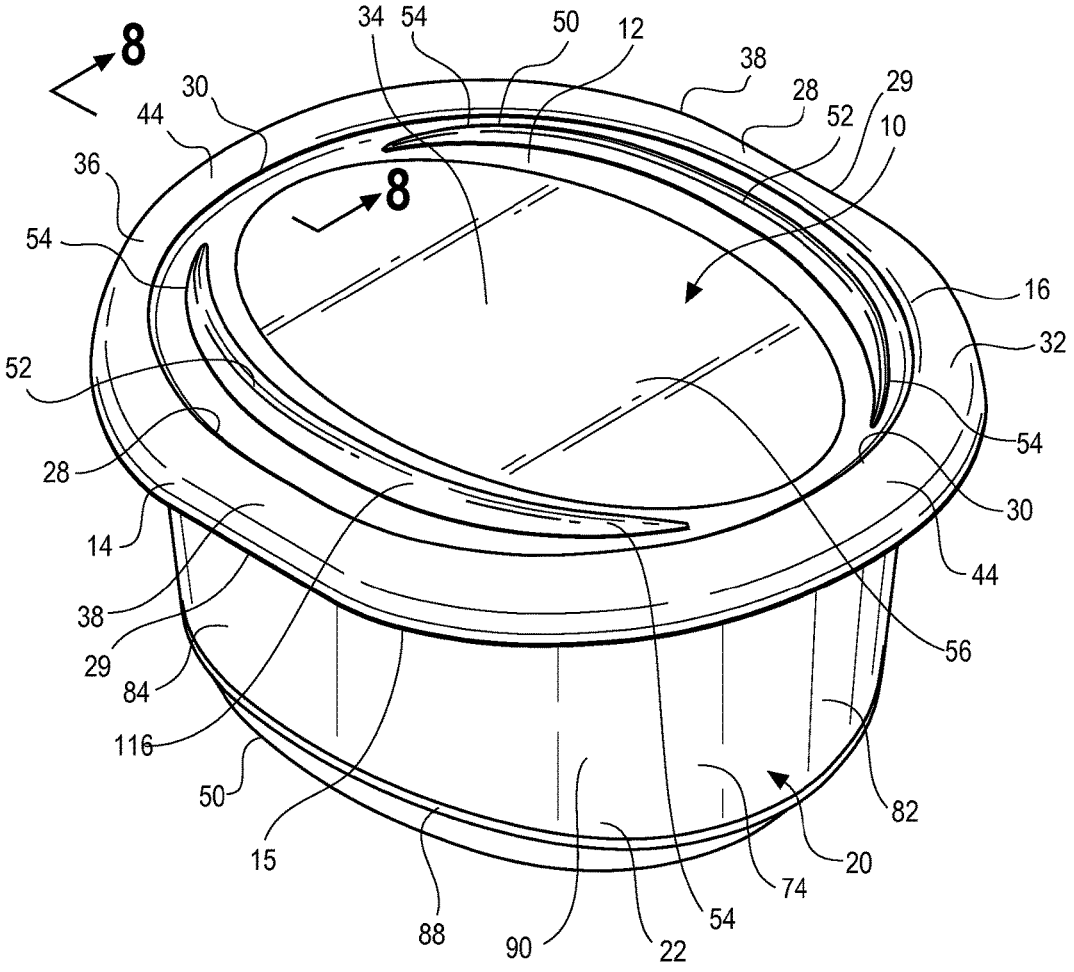
FIG. 1 is a perspective view of a container showing a container lid removably secured to a container base.

A container is provided herein that is uniquely suitable for use in a hot-fill process. Pursuant to this, the container can include strengthening features so that the container, including the lid and/or the base, does not undesirably deform as a result of the heat of the hot-fill process or forces acting on the container during the process or thereafter, such as stacking of the containers or the like. Moreover, the strengthening features can also be utilized to provide secure and uniform stacking of the containers after assembly thereof. With this, the containers have a uniform appearance when stacked, such as on display on a shelf, with labels thereon all uniformly forwardly facing.

More details of one example lid are shown in FIGS. 1-8. The lid 10 includes a top wall portion 12 and a skirt. 14 depending downwardly from a perimeter 16 of the top wall portion 12. The top wall 12 is configured to cover an open mouth 18 of a container base 20, discussed in more detail below, and the skirt 14 is configured to extend downwardly along an outer wall of the container base 20 to engage an edge 24 thereof so that the lid 10 is removably secured to the container base 20. More specifically, the skirt 14 can include an inwardly protruding rib 26 or the like to engage the edge 24 of the container base 20. In the illustrated form, the lid 10 has a generally oval configuration with generally longer side portions 28 and generally shorter end portions 30. The end portions 30 are rounded, while the side portions 28 can include linear portions 29 for a track shape, as shown, or can be rounded. The linear portions 29 of the lid sides are on an outer surface 15 of the skirt 14. As such, during conveyance during the filling and sealing process, as well as other manufacturing processes, the outer surface 15 of the skirt 14 provides the most outwardly positioned surface for manipulation of the container. The linear portions advantageously provide a much more reliable gripping surface for the container as compared to a curved surface and help the machinery to consistently orient the lid 10 and container. In one form, the linear portions 29 are about 1 inch in length or longer. Additionally, the skirt 14 can include a lip 17 extending outwardly therefrom, such as from a bottom edge thereof. The lip preferably is generally planar and generally parallel to a longitudinal axis through the lid 10. The lip 17 can extend around the entire skirt 14, or only a generally central portion of the side thereof, as shown. During the filling and sealing manufacturing process, a plurality of lids 10 can be stacked prior to being applied to a container base 20. The planar structure of the lip 17 acts to effectively retain stacked lids within a manufacturing chute when a bottom lid is removed from the stack.

As shown, the lid top wall 12 can include a raised peripheral region 32 extending around the perimeter 16 thereof. The raised peripheral region 32 can have a rounded appearance as illustrated, or can have additional edges or planar features as desired, such as a flat upper surface. The raised peripheral region 32 provides a transition between a central region 34 of the top wall 12 and the skirt 14. A top surface 36 of the raised peripheral region 32 can be generally planar or can have a curvilinear or saddle-type structure, as shown. More specifically, side portions 38 of the raised peripheral region 32 have a downward curvature relative to a plane through the top wall portion. 12 such that the side portions 38 have an intermediate low point or portion 40 and legs 42 curving upwardly therefrom. The end portions 44 of the raised peripheral region 32 have an upward curvature relation to a plane through the top wall portion 12 such that the end portions 44 have an intermediate high point or portion 46 and legs 48 curving downwardly therefrom. As such, intermediate high point or portions 46 of the raised peripheral region end portions 44 provide the highest points of the raised peripheral region 32, which are preferably generally planar.

As discussed previously, the lid 10 can be subject to both heat and pressure during the hot-fill process and subsequent storage of the filled containers. In order to strengthen the lid 10 against deformation during these processes, the lid 10 can further include one or more ribs 50 extending along portions of the top wall 12 thereof. The ribs 50 protrude from adjacent portions of the top wall 12, which can otherwise be generally planar, as shown. In the illustrated form, the ribs 50 are spaced inwardly from the raised peripheral region 32, so that the ribs 50 are isolated within the lid central region 34. If desired, however, the ribs 50 can extend into the raised peripheral region 32 or other areas of the lid 10. The ribs 50 include a raised central portion 52 and two downwardly tapering end portions 54 that transition the ends 54 of the ribs 50 from a level of the top wall 12 to the raised central portion 52. The ribs 50 can also have breaks therein if desired. Preferably, though not necessarily, the ribs 50 do not intersect the raised peripheral region 32 but rather are entirely spaced therefrom to provide structural support in the central region 34 of the lid 10.

In the illustrated form, the lid 10 can include two ribs 50 that extend across a portion of the lid central region 34. More specifically, the ribs 50 extend along the relatively longer sides 28 of the lid top wall 12 as opposed to the relatively shorter ends 30 thereof because the ribs 50 can extend over a greater portion of the lid 10 and therefore provide more strengthening. Additionally, due to the curvature and relatively shorter width of the ends 30, the sides 28 can be inherently structurally weaker.

Commonly, labels are applied to container lids to advertise brands and/or provide other information regarding the company and product within the container. Due to the ribs 50, however, the central region 34 of the top wall 12, which could otherwise be generally planar and therefore ideal for label placement, is divided into a number of generally planar regions. Moreover, as shown, the perimeter 16 of the lid top wall 12 and the container base outer wall 22 both have rounded configurations, and, more specifically, generally oval footprints. As such, the ribs 50 can have generally complementary arcuate configurations which provide both a distinct aesthetic, but also maximizes a central label region 56 of the top wall 12 that is bordered by the ribs 50. Of course, a label can be placed over the ribs 50 or have openings therein corresponding to the location of the ribs 50.

In one form, the ribs 50 can be configured such that between about 75% and 80% of the space inward of the ribs 50 is bounded by the ribs 50, with between about 20% and 25% of the space is free. In the preferred form, the free space is disposed along the major axis of the lid 10, e.g., near the narrower width ends of the lid 10. This advantageously allows a label on the planar portion of the lid 10 to extend into the space that would otherwise be occupied if the two ribs 50 were instead one contiguous lid. Furthermore, the maximum width of the ribs 50 is at or near the minor axis of the lid 10, while the minimum width of the ribs 50 is closer to the major axis of the lid 10. The minimum height of the ribs 50 can also be closer to the major axis of the ribs 50. Each rib 50 can also be symmetric about the minor axis, while the two ribs 50 are symmetric about the major axis.

Figure 2:
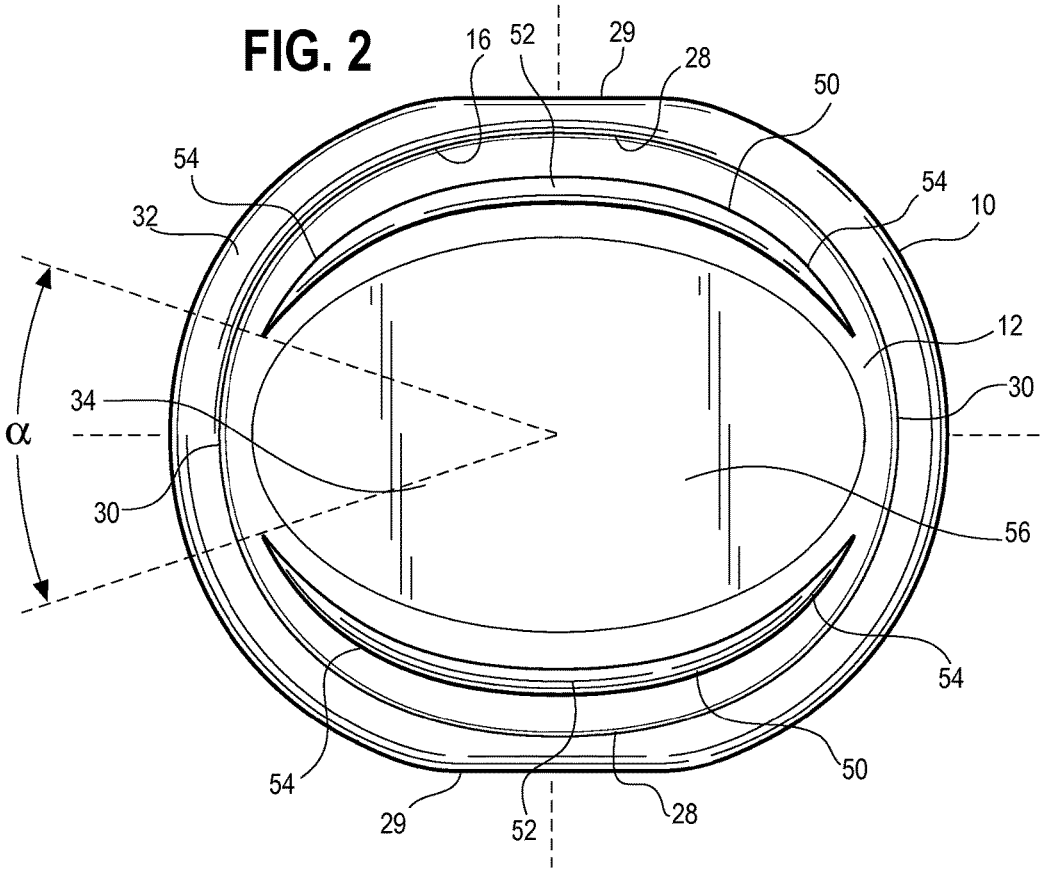
FIG. 2 is a top plan view of the container lid of the container of FIG. 1.
Figure 3:
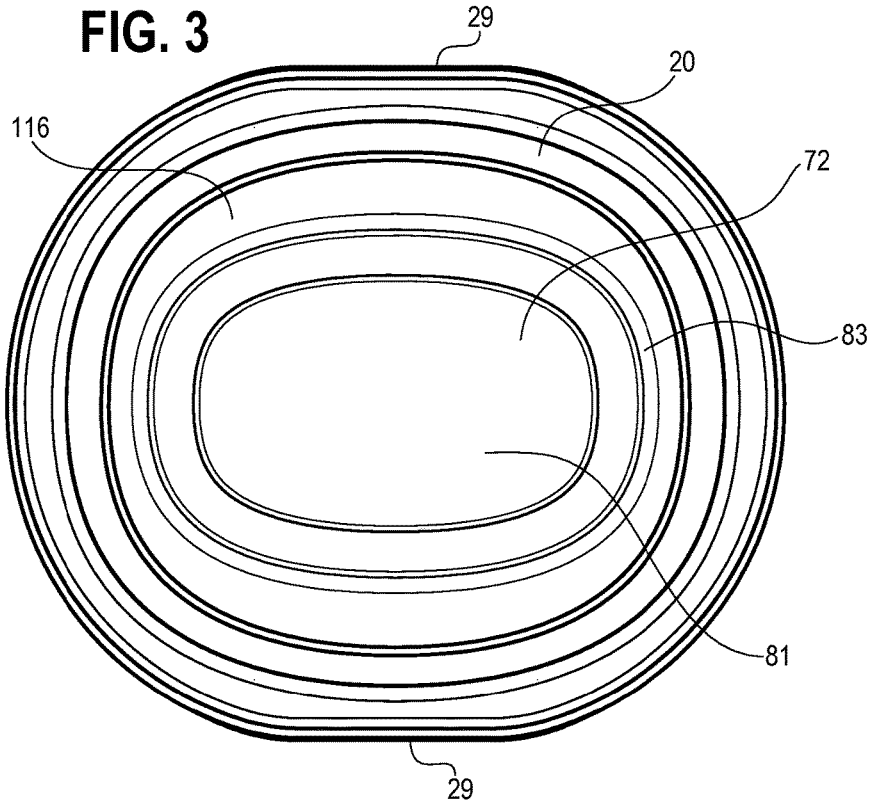
FIG. 3 is a bottom plan view of the container base of the container of FIG. 1.

An advantageous result of the configuration shown in FIGS. 1 and 2, is that the lid 10 is strengthened by the ribs 50, but also that the area of the label region 56 of the lid top wall 12 between the ribs 50 is maximized by the ribs 50 being generally complementary to the shape of the perimeter 16 of the top wall 12. For example, the ribs 50 as shown are outwardly arcuate when viewed from above the lid 10 and generally complementary with the generally oval configuration of the perimeter 16 of the top wall 12. More specifically, the tapered ends 54 of the ribs 50 curve generally toward each other so that the ribs 50 combine to define the generally oval label region 56. Linear or linearly segmented ribs would not provide as much area for the label area. If, however, the footprint of the top wall 12 had a different configuration, the shape and configuration of the ribs can be adjusted as necessary. Moreover, as a result of being broken into two ribs as shown, a label applied therebetween can be longer, such as having a more oval shape, than a label applied within a continuous ring or the like. Additionally, the spaced ribs allow the lid to be more longitudinally flexible, which can provide flexibility for when a consumer secures the lid to the base and removes the lid from the base.

Next, as shown in FIGS. 4, 5, and 7-10, a lower or bottom edge 58 of the skirt 14 can have a non-linear pattern, such as the undulating or saddle pattern as shown. This saddle pattern gives the lid 10, and specifically the skirt 14 thereof, a unique look that can differentiate the container from other adjacent containers on a shelf. In the form shown, the bottom edge 58 of the skirt 14 includes side portions 60 and end portions 62 corresponding to the side 28 and end portions 30 of the top wall 12. The side portions 60 of the skirt bottom edge 58 include an intermediate low point or portion 64 and legs 66 that curve upwardly therefrom toward the skirt end portions 62. Meanwhile, the end portions 62 of the skirt bottom edge 58 include an intermediate high point or portion 68 and legs 70 that curve downwardly therefrom toward the skirt side portions 60. So configured, the curvature of the skirt bottom edge 58 is generally complementary to the curvature of the raised peripheral region 32, set forth above. As such, the height of the skirt 14 between the bottom edge 58 thereof and the top surface 36 of the raised peripheral region 32 is generally uniform around the entire periphery 16 of the lid 10.

While this provides a unique appearance for the lid 10, the undulating pattern makes it so that a bottom surface of the lid 10, i.e., the skirt bottom edge 58, is not planar. As such, the lid 10 cannot be stably rested on a planar surface in an upward orientation, i.e., with the top wall 12 facing upward and portions of the skirt 14 resting on the planar surface. Advantageously, the intermediate point or portion 68 of the raised peripheral region end portions 62 and/or an upper surface 36 of the central portion 40 of the ribs 50 can be generally planar so that the lid 10 can be stably rested in a downward orientation. As such, the ribs 50 can support the lid 10 along the sides 28 thereof and the raised peripheral region 32 can support the lid 10 along the ends 30 thereof. This gives the lid 10 four distinct points or portions of support, which provides for secure stacking, storage, and shipment of groups of lids 10.

Figure 7:
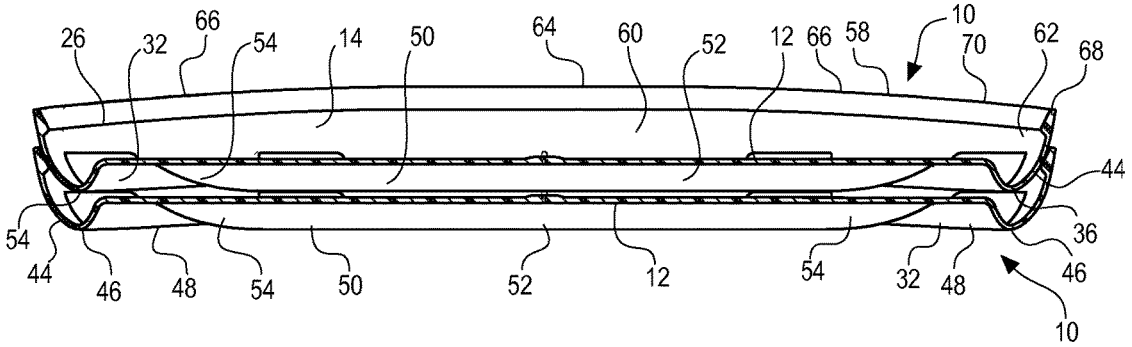
FIG. 7 is a cross-sectional side view of a pair of container lids as shown in FIG. 1 in a stacked orientation.
Figure 8:
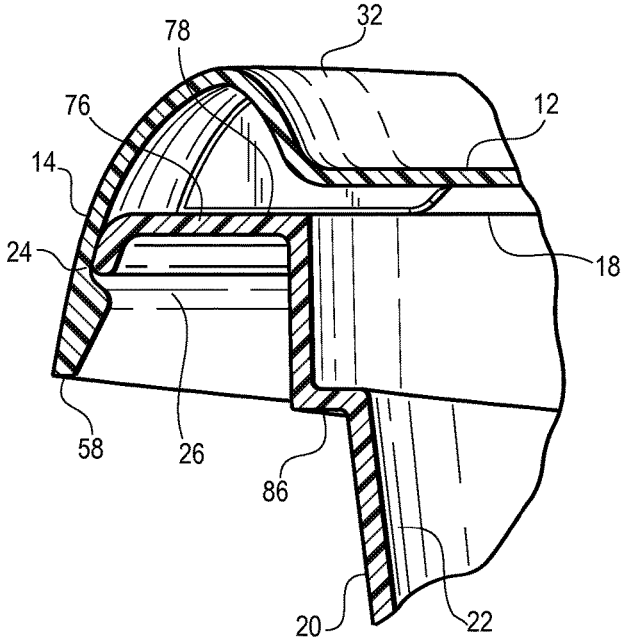
FIG. 8 is a sectional view of engagement of the container lid and container base as shown in FIG. 1.
Figure 13:
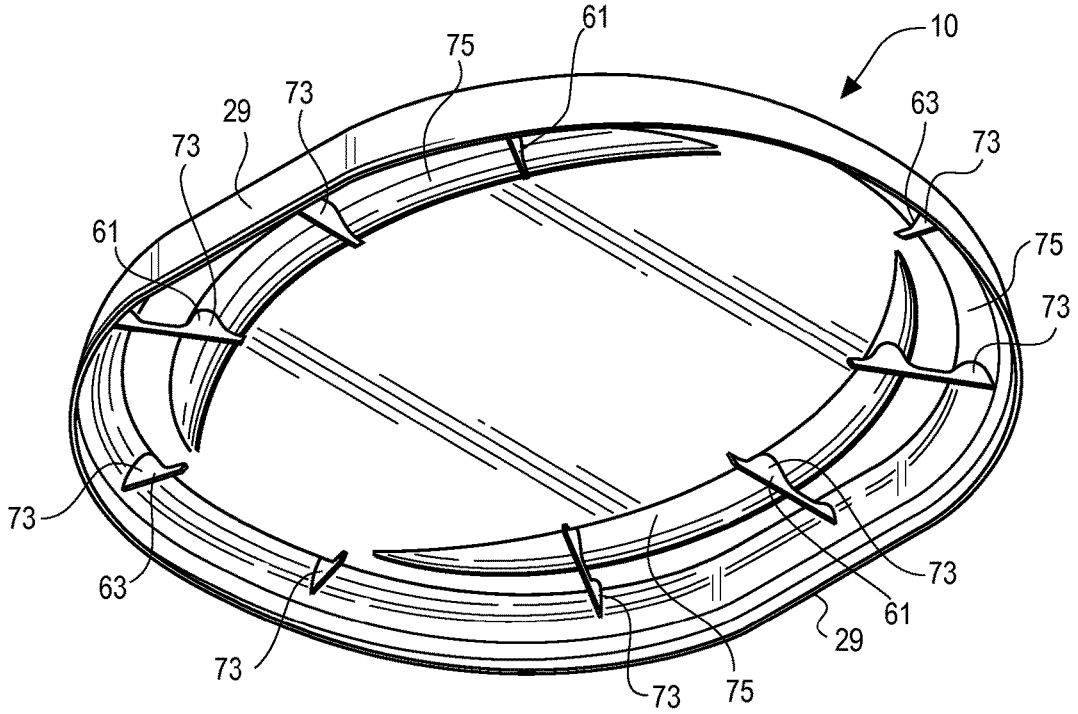
FIG. 13 is a bottom perspective view of a container lid showing strengthening ribs extending from a central region thereof to an outer edge thereof.
Figure 14:
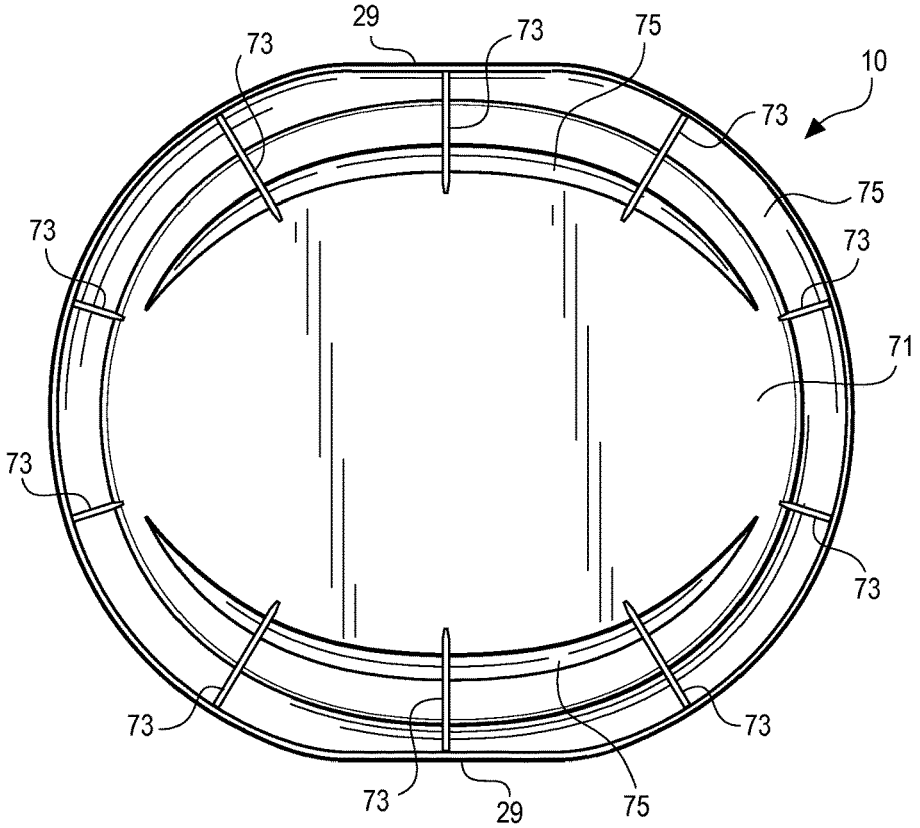
FIG. 14 is a bottom plan view of a container lid showing strengthening ribs extending from a central region thereof to an outer edge thereof.
Figure 15:
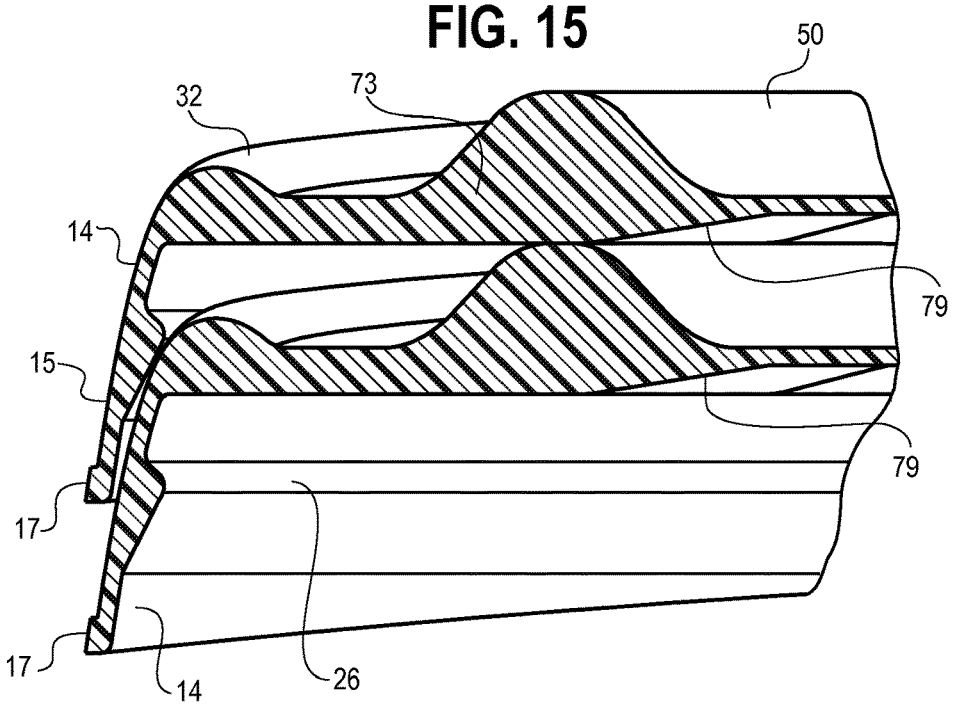
FIG. 15 is a sectional view of a pair of container lids in a stacked orientation showing the strengthening ribs spacing the lids apart.

During transportation, storage, and creation of the filled container, a plurality of lids 10 can be stacked. A common problem that can result from stacking closed lids or contains is that a vacuum can be created between the nested lids. The vacuum can make it difficult to subsequently separate the lids 10. In order to prevent the lids 10 from nesting too closely together and therefore create the aforementioned vacuum, the lids 10 can include a plurality of strengthening or support ribs or braces 73 spanning the cavities 75 created by the raised peripheral region 32 and ribs 50 on a bottom surface 71 of the lid 10, as shown in FIGS. 13 and 14. So configured and one example of which is shown in FIG. 15, the four portions of support of the lid 10 abut one or more of the spanning braces 73 rather than project into the cavities 75. More specifically and in the illustrated form, the lid includes ten spanning braces 73, which include three side braces 61 spaced along each side portion 28 thereof and two end braces 63 spaced along each end portion 30 thereof. Each center side brace 61 is preferably centered with respect to the lid side portion 28 and, as such, is configured to abut the central portion 40 of the ribs 50, as shown in FIG. 15. The end braces 63 are spaced on either side of the center of the lid end portions 30 and, as such, are configured to both abut the intermediate portion 68 of the raised peripheral region end portion 62, as shown in FIG. 7. Alternatively, the lid 10 could include only one centered end brace 63 on each end thereof and/or one centered side brace 61 on each side thereof. Of course, other numbers of ribs 73 could also be utilized. The spanning braces 73 can further extend generally radially as shown, or can have other configurations to abut the points of support.

As shown in FIGS. 13-15, the side braces 61 span across the cavities 75 created by both the ribs 50 and the raised peripheral region 32. This configuration advantageously strengthens the ribs 50, and therefore the top wall 12, from deformation by inhibiting the sides of the ribs 50 from spreading apart from one another as a result of a stacking load or the like. For example, if another container was stacked on the lid 10, the ribs 50 would have a tendency to widen as a result of the downward force of the stacked container. The side braces 61 act to attach the walls of sides of the ribs 50 together and prevent or restrict this widening. This also acts to minimize deflection of the top wall 12 downwardly as a result of the ribs 50 widening.

As discussed previously, the foil cover 77 and the container lid 10 are applied over the container base 20 after the hot-filled contents are deposited therein. Due to the heat of the contents, the foil 77 can initially bubble or dome outwardly so that it contacts the bottom surface 71 of the lid 10. In order to minimize potential damage to the foil cover 77, inboard end portions 79 of the spanning ribs 73 can gradually taper toward the lid central region 34. This minimizes a distinct point of impact on the foil 77, which can undesirably rupture the foil cover 77.

Figure 16:
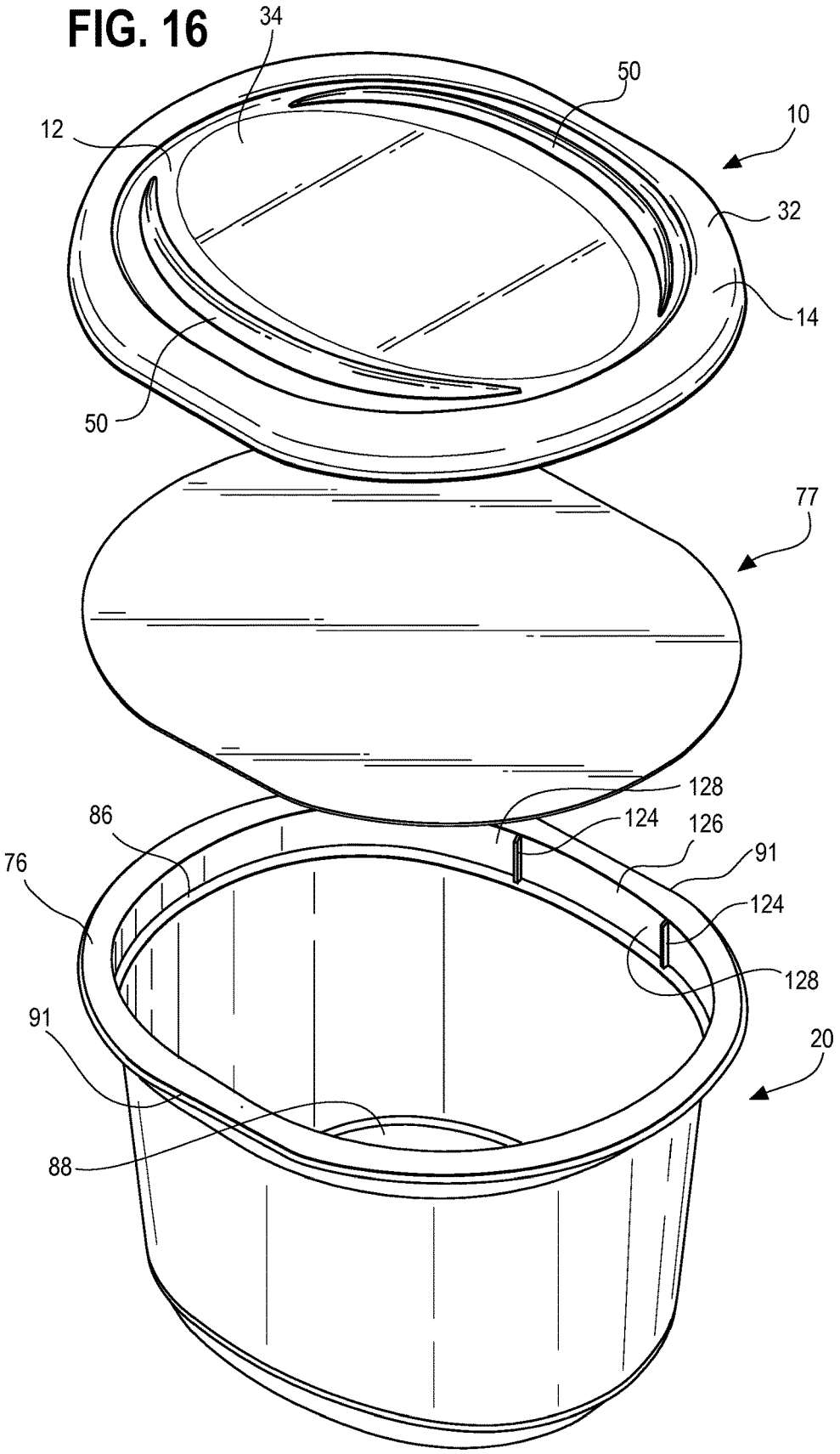
FIG. 16 is an exploded perspective view showing a container including a container lid, a foil cover, and a container base.

Now details of the container base 20 will be described with reference to FIGS. 1, 4-6, and 8-10. As shown, the base 20 includes a bottom wall portion 72 and an upstanding sidewall portion 22, which can taper outwardly. The sidewall portion 22 extends upward to an outwardly extending flange or lip 76 that provides a generally planar top surface 78 of the container base 20. The edge 24 of the flange 76 is configured to engage the rib 26 of the lid skirt 14 to secure the lid 10 to the base 20. In the form illustrated in FIG. 16, the side portions of the flange 76 each include an intermediate linear region 91, which can be generally centered with respect thereto. During conveyance during the filling and sealing process, as well as other manufacturing processes, the flange 76 provides the most outwardly positioned surface for manipulation of the container. As such, the linear portions 91 advantageously provide a much more reliable gripping surface for the container as compared to a curved surface and help the machinery to consistently orient the base 20. In one form, the linear portions 91 are about 1 inch in length or longer. The bottom wall portion 72 can include a central recessed portion 81 and a generally flat abutment portion 83 extending therearound. The recessed portion 81 is configured to accommodate expansion of the container base 20 as a result of heat and weight from the hot-filled contents. The recessed portion 81 should be configured to able to expand downwardly without extending past a plane of the abutment portion 83 so that the container can stably rest on a surface. For example, in an 8 oz or 12 oz container base 20, the recessed portion 81 can be recessed about 1 mm, while in a 16 oz container base, the recessed portion 81 can be recessed about 2 mm. The abutment portion 83 is preferably of a sufficient width so that the weight of the container, when stacked on another container, is spread out over a large enough area to avoid deforming the lid 10 of the other container. In the illustrated form, the abutment portion 83 is about 2 mm wide or larger.

Figure 4:
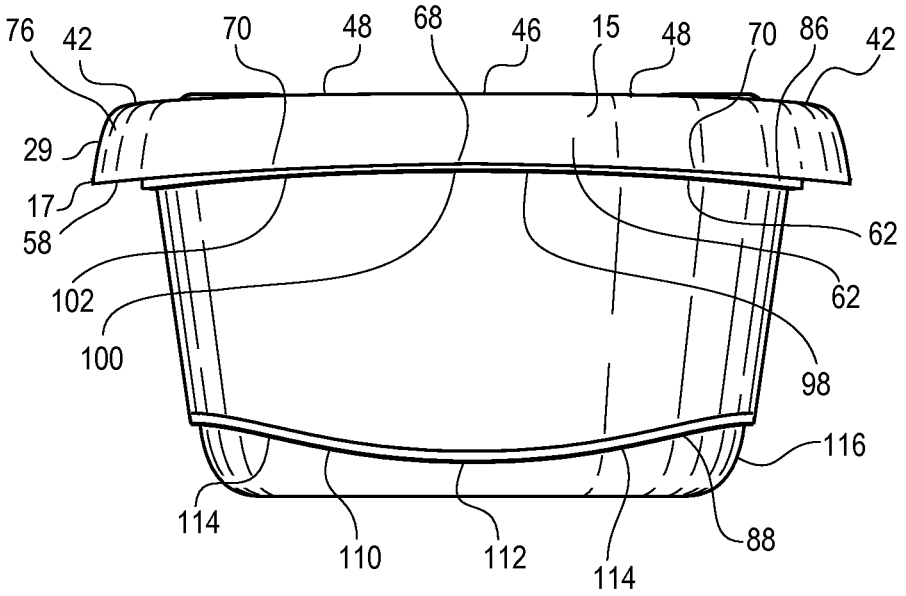
FIG. 4 is an end elevation view of the container of FIG. 1 showing end portions of the container lid and container base, the opposite end elevation view thereof being an identical image.
Figure 5:
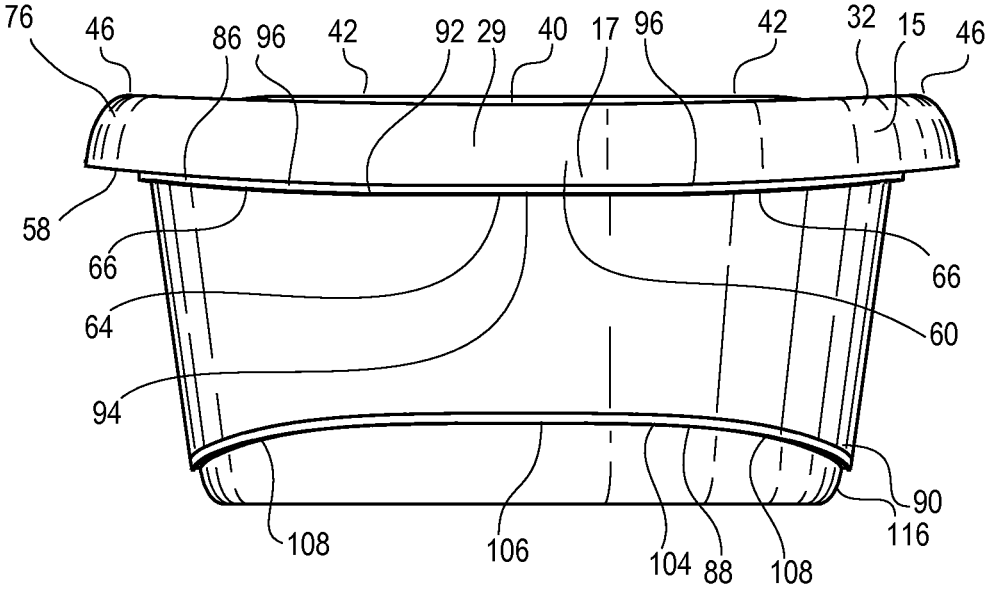
FIG. 5 is a side elevation view of the container of FIG. 1 showing side portions of the container lid and container base, the opposite side elevation view being an identical image.
Figure 6:
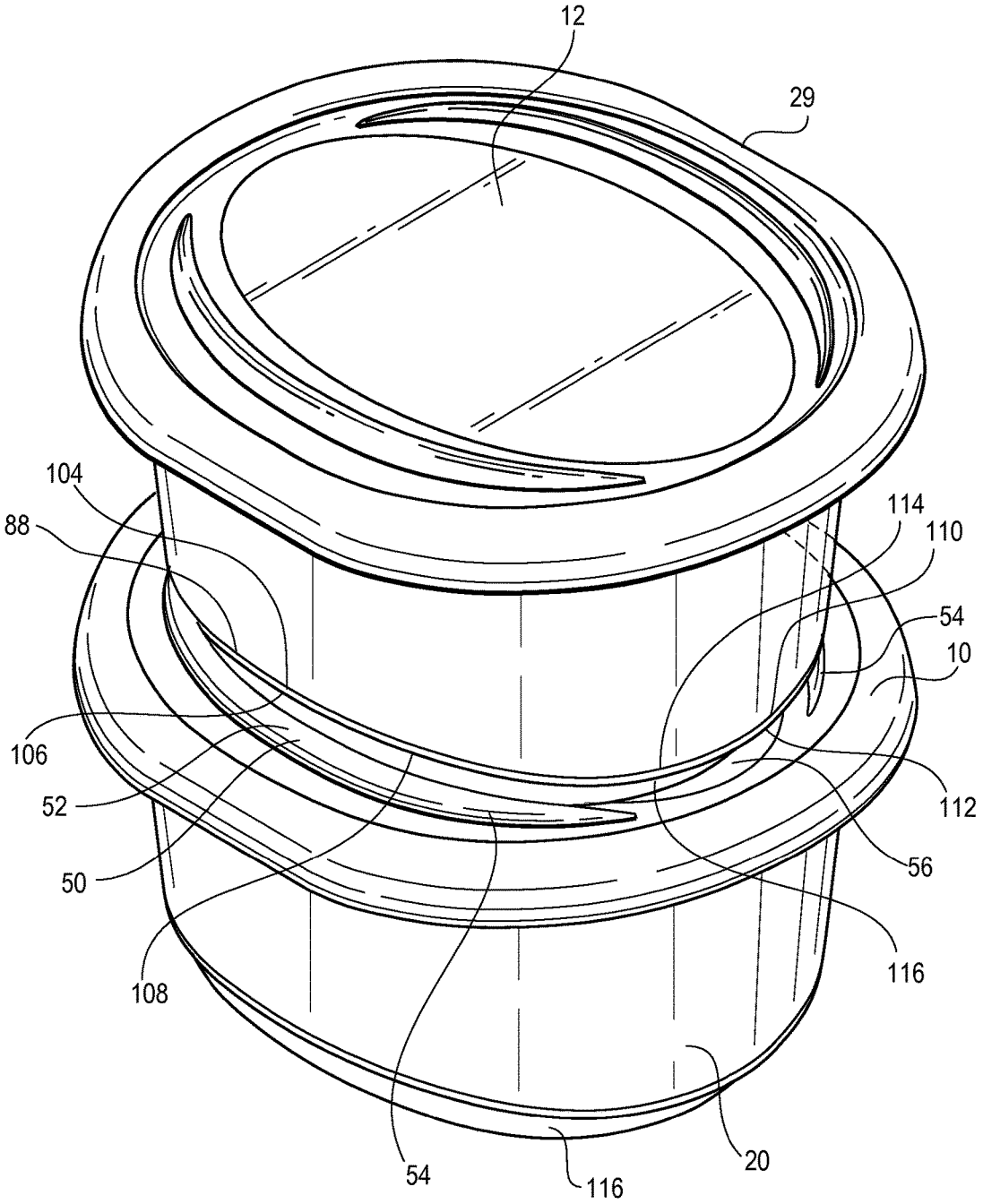
FIG. 6 is a perspective view of a pair of containers as shown in FIG. 1 in a stacked orientation, the containers having container lids and container bases showing ribs on the bottom container lid engaging a lower portion of the upper container base to restriction rotation thereof.
Figure 9:
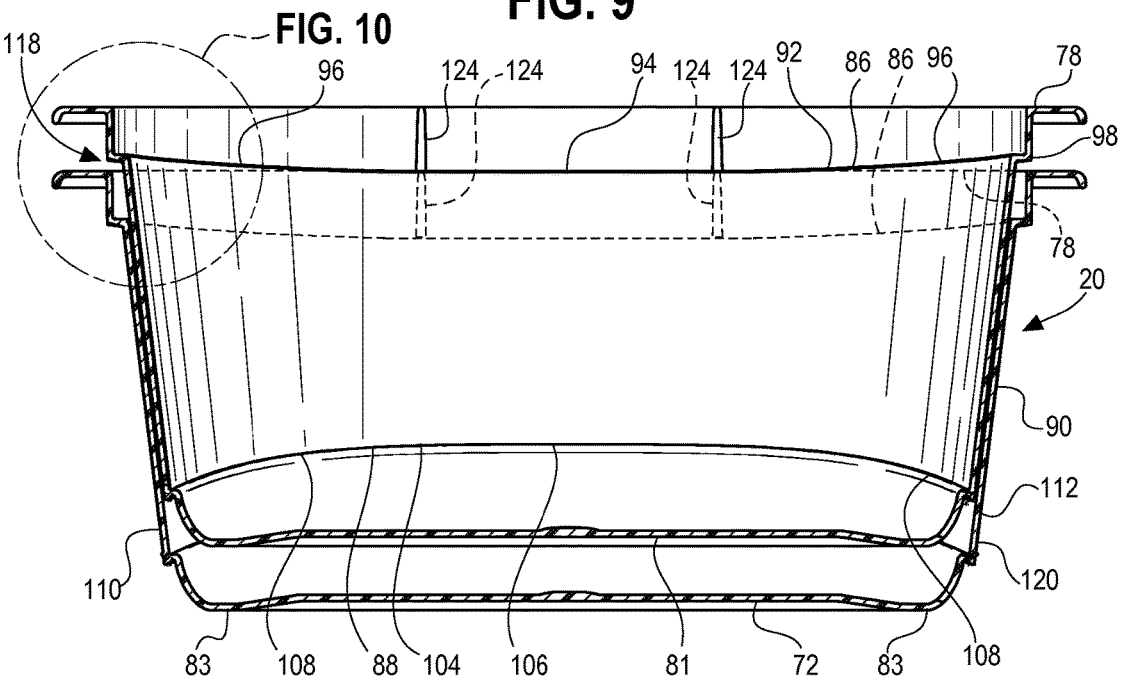
FIG. 9 is a cross-sectional side view of a pair of container bases as shown in FIG. 1 in a nested orientation.

As discussed previously, the bottom wall can have a generally oval or track-shaped footprint and, as such, the sidewall 22 can include end wall portions 82 that are arcuate in a horizontal plane and side wall portions 84 extending therebetween. The side wall portions 84 can be arcuate in the horizontal plane as shown or the bottom wall can have a track shaped configuration with generally linear sidewall portions. Moreover, the transition between the bottom wall 72 and the sidewall 22 can be rounded, as illustrated in FIGS. 4, 5, and 9. The rounded transition, including corners with large radii, can facilitate removal of food product from within the container, such as with a knife, spoon or other utensil. Moreover, the tapering sidewall 22 and the rounded transition can allow the base to fit within the label region 56 of the lid 10. The oval configuration of the container base 20 and lid 10 allows the container to be oriented so that the end portions or side portions face forwardly when placed on a shelf. This can advantageously be utilized in response to limited shelf space or the like.

In order to strengthen the sidewall 22, the sidewall 22 can further include one or more shoulders or ribs extending thereacross. As shown, the sidewall 22 includes upper 86 and lower shoulders 88 extending generally horizontally around the sidewall 22, which can define a sidewall label area 90 therebetween. The shoulders 86, 88 of the illustrated form take the form of outwardly projecting generally horizontal wall portions, but other suitable forms could also be utilized, such as, inwardly projecting wall portions or ribs that include inwardly and outwardly projecting wall portions. In one form, the lower shoulder 88 can have an upturned inner region formed by a complementary feature in a mold cavity. This can allow the complementary feature of the mold cavity to retain an in-mold label during an in-mold label forming process.

Advantageously, the shoulders 86, 88 can each have non-linear and, more specifically, undulating or saddle-type patterns similar to or opposite of the bottom surface of the lid skirt 14 described above. As shown, the upper shoulder 86 generally complements the curvature of the skirt bottom edge 58 so that it includes side portions 92 with an intermediate low point or portion 94 and legs 96 curving upwardly therefrom and end portions 98 with an intermediate high point or portion 100 and legs 102 curving downwardly therefrom. The lower shoulder 88 can then have a configuration opposite of the upper shoulder 86 so that it includes side portions 104 with an intermediate high point or portion 106 and legs 108 curving downwardly therefrom and end portions 110 with an intermediate low point or portion 112 and legs 114 curving upwardly therefrom.

So configured, the upper and lower shoulders 86, 88 curve toward each other on the side wall portions 84 and curve away from each other on the end wall portions 82. Moreover, the bottom surface 58 of the skirt 14 and the raised peripheral region 32 are generally complementary to the curvature of the upper rib 86. As such, the lid 10 and container base 20 have a complementary aesthetic that provides on-shelf appeal and competitive differentiation. Moreover, having the upper and lower shoulders 86, 88 closer to each other proximate the middle of the side wall portions 84 can advantageously provide for improved rigidity for the side wall 84. Such improved rigidity can be of lesser significance on the end walls 82 due to the end walls 82 having a span less than that of the side walls 84. Thus, vertical label space on the end walls 82 can be increased as compared to the side walls 84 while providing for improved rigidity of the side walls 84.

As briefly discussed above, the containers described herein are configured to be stacked upon one another. Specifically, the container base 20 includes a lower portion 116 bordered by the sidewall lower shoulder 88 and the base bottom wall portion 72. This lower portion 116 is sized and configured to fit in the label region 90 of the lid 10 between the lid ribs 50. The lid ribs 50 act to restrain the stacked container base 20 from rotation and orient the stacked container uniformly with the lower container. As shown, the curvature of the lower shoulder 88 can be generally complementary to the structure of the lid ribs 50 so that the base lower portion 116 fits easily between the lid ribs 50. More specifically, the lower shoulder side intermediate high portion 106 and downwardly curving legs 108 align with the raised central region 52 of the lid ribs 50 and the lower shoulder end intermediate low portion 112 and upwardly curving legs 114 align with the rib-free end portions of the lid central region 34. The tapering ends 54 of the lid ribs 50 align with the transition of the lower shoulder 88 from the side 104 to the end portions 110 thereof.

Figure 10:
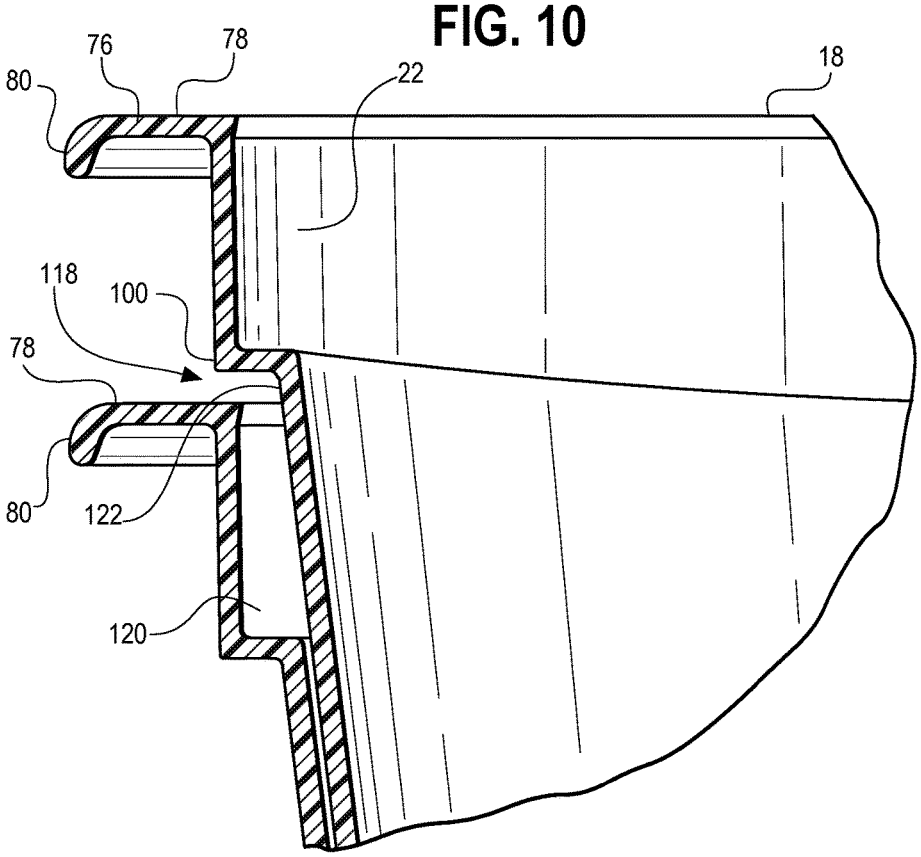
FIG. 10 is a sectional, view of the region of the nested container bases circled in FIG. 9

One advantageous feature provided by the upper shoulder 86 of the container base 20 is that it provides a venting feature when multiple container bases 20 are stacked or nested together. A common problem that can result from stacking tubs or similarly structured containers is that a vacuum can be created between the nested containers. The vacuum can make it difficult to subsequently separate the containers. The undulating pattern of the upper shoulder 86 creates a vent 118 to the interior of the container base 20 with a stacked container base 20 fully inserted therein, as shown in FIGS. 9 and 10. The intermediate low point or portion 94 of the upper shoulder side portions 92 are configured to rest on the top surface 78 of a lower container base 20. The upper shoulder end portions 98, and specifically the intermediate high point or portion 100 thereof, is therefore spaced from the top surface 78 of the lower container base 20. This spacing creates the vent 118, which allows air to flow freely into the interior of the lower container base 20.

The vent 118 can also be advantageously utilized for a visual orientation feature. Uniform orientation can be necessary in a high-volume manufacturing process. In one form, the manufacturing process utilizes a stack of container bases from which machinery can remove individual bases as needed. A clear visual indication of the container orientation can aid in maintaining the high speed process. Commonly container bases and lids can include a molded mark for users to use when visually inspecting a stack. With the vent 118, however, a portion of the labeling on the nested container 20 can be seen through the vent 118. Thus, an orientation mark 122 can simply be primed on the labeling of the container base 20 so that it is visible through the vent 118 of a lower container base 20 rather than separately molded into the base 20. This saves manufacturing costs and allows for greater flexibility in the size and nature of the mark.

Due to the generally flexible sidewalls 22, if enough weight is applied to a stack of container bases 20, the bases 20 can deform inwardly so that the upper shoulder 86 slides inwardly off of the lower container top surface 78. As such, a base 20 can be forced into a lower base, which can be referred to as "telescoping," deforming the container bases and making it difficult to subsequently separate the stack of bases. In order to protect against telescoping, the container base 20 can include a one or more vertical ribs 124 extending from the upper shoulder 86 to the top surface 78 of the base 20 along an interior surface thereof 126. In the form illustrated in FIGS. 9 and 16, the base 20 includes two of the vertical ribs 124 spaced on either side of a center thereof. The ribs 124 provide additional width to the sidewall 22 to support the upper shoulder 86 of a stacked container base 20 thereon. As discussed above, upon cooling of the hot-fill contents, the foil 77 can concavely deflect into the container base 20. As such, the foil 77 can abut the vertical ribs 124. In order to prevent damage and possible tearing of the foil 77, a top surface 128 of the vertical ribs 124 can be chamfered as shown, such as an at angle of about 15 degrees to about 60 degrees, and more preferably about 40 degrees.

Figure 11:
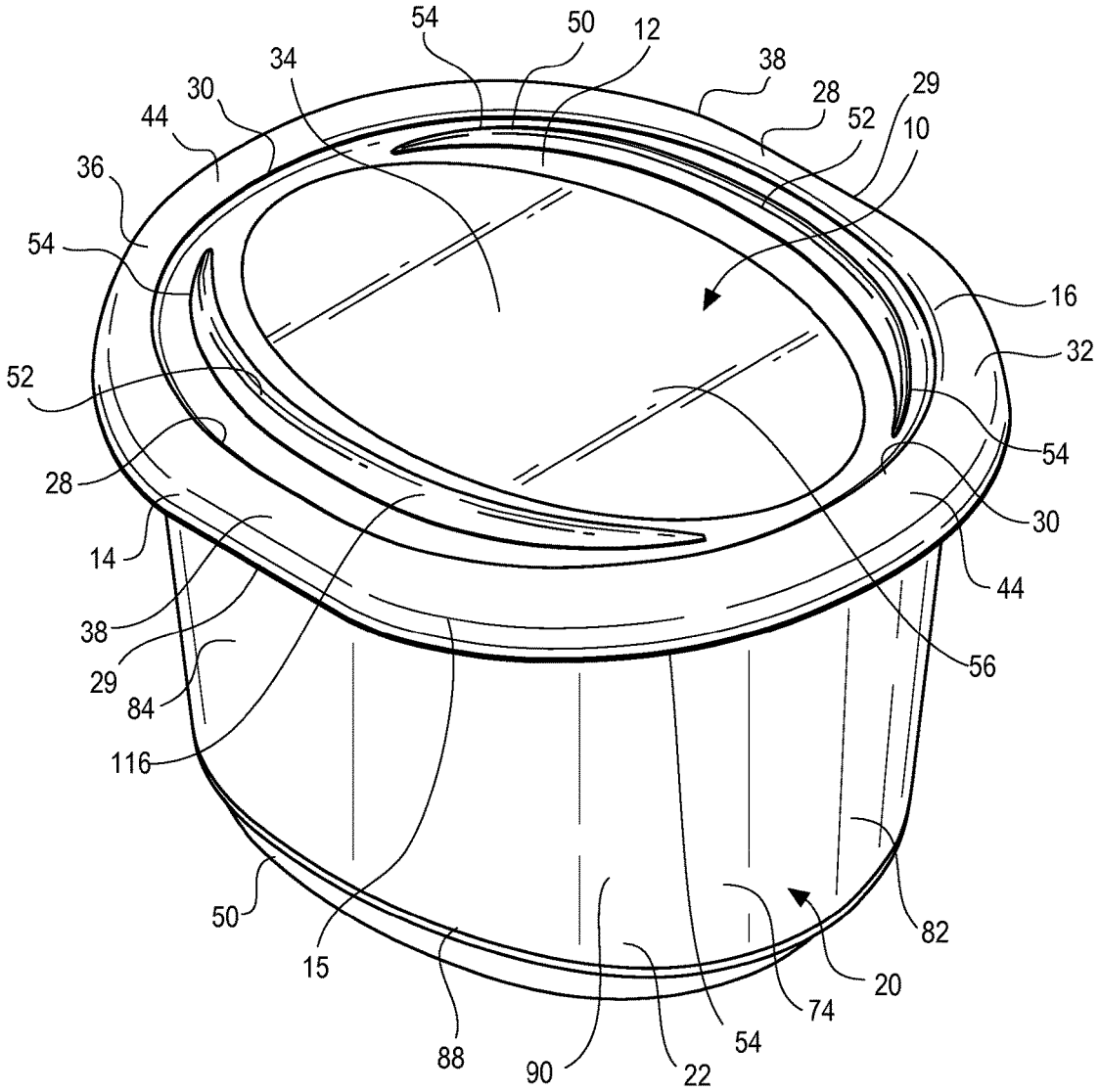
FIG. 11 is a perspective view of a second embodiment of a container showing a container lid removably secured to a container base.
Figure 12:
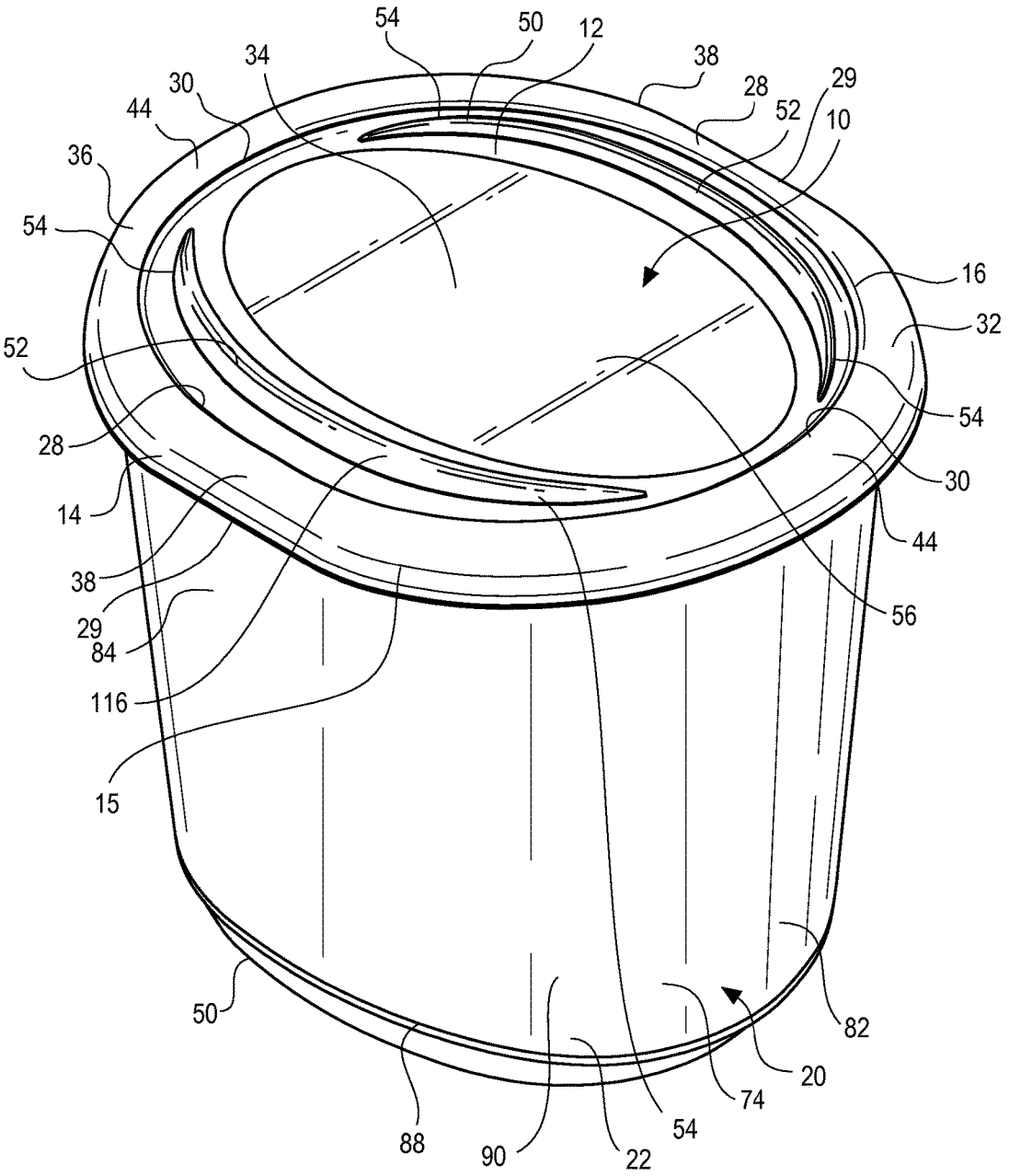
FIG. 12 is a perspective view of a third embodiment of a container showing a container lid removably secured to a container base

The container base can be sized to fit any desired amount of contents therein. For example, the container of FIG. 1 can be sized to receive 8 oz. of food product therein, the container of FIG. 11 can be sized to receive 12 oz. of food product therein, and the container of FIG. 12 can be sized to receive 16 oz. of food product therein. The food contents can be cream cheese spread, cheese spreads, or other such hot fillable food products. Moreover, although advantages of the various embodiments described herein are described with respect to a hot fill process, the containers described herein can also be utilized in a cold fill process and maintain several of the advantages disclosed.

Those skilled in the an will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

The invention claimed is:

1. A non-circular, removable lid for a container, the lid comprising:

a top wall portion having a raised perimeter including contiguous side edge portions and end edge portions;

a skirt portion depending downwardly from the raised perimeter of the top wall portion and having a free edge, opposite the raised perimeter, with corresponding side edge portions and end edge portions;

two or more raised ribs of the top wall portion extending along the raised perimeter and being entirely spaced from the raised perimeter, the raised ribs defining a planar label region therebetween and strengthening the top wall portion against deformation under stacking loads; and four or more spanning braces adjacent a bottom surface of the top wall portion, the spanning braces including transverse wall portions spanning across cavities created by the raised ribs on the bottom surface of the top wall portion, the transverse wall portions preventing the raised ribs from spreading apart as a result of stacking loads being placed on the lid;

wherein inward end portions of the spanning braces are chamfered, the spanning braces configured to deflect downwardly with deflection of the top wall portion under a stacking load such that the chamfered end portions minimize contact of the spanning braces with any material spanning beneath the lid.

2. The lid of claim 1, wherein the end edge portions of the raised perimeter are arcuate so that the top wall portion has a generally oval configuration, and the raised ribs include arcuate portions that are generally complementary to the arcuate end edge portions.

3. The lid of claim 1, wherein the raised perimeter of the top wall portion has a maximum height above the planar label region proximate a middle of the end edge portions and a minimum height about the planar label region proximate a middle of the side edge portions.

4. The lid of claim 3, wherein the maximum height of the raised perimeter of the top wall portion above the planar label region is substantially the same as a maximum height of each of the raised ribs disposed adjacent the side edge portions of the raised perimeter such that the lid has a position of stability when supported on the raised ribs and end edge portions of the raised perimeter.

5. The lid of claim 4 in a stack of similarly configured lids, wherein the portions of the raised perimeter corresponding to the maximum height thereof and the portions of the raised ribs corresponding to the maximum height thereof are configured to abut adjacent bottom surfaces of an adjacent lid in the stack so that the stack is more stable.

6. The lid of claim 1 in a stack of similarly configured lids, wherein individual ones of the spanning braces are configured to abut portions of the raised perimeter corresponding to a maximum height thereof and portions of the raised ribs corresponding to a maximum height thereof of an upwardly adjacent lid in the stack so that the stack is stable.

7. The lid of claim 1, wherein the free edge of the skirt portion along the side edge portions thereof has a maximum vertical distance from the planar label region and the free edge of the skirt portion along the end edge portions thereof has a minimum vertical distance from the planar label region such that the lid lacks a position of stability when supported by the free edge of the skirt portion.

8. The lid of claim 1, wherein the skirt portion has a track-shaped footprint with linear side regions, the linear side regions configured to provide larger engagement surfaces for conveyance machinery to maintain orientation as compared to rounded side regions.

9. The lid of claim 1, in combination with a container base, wherein the lid is configured to removably engage the container base, the container base including:

a bottom wall portion having a perimeter that includes side edge portions and end edge portions; and a sidewall portion extending upwardly from the perimeter of the bottom wall portion to a non-circular, planar peripheral rim surrounding an opening, the sidewall portion including a pair of side wall portions, a pair of end wall portions, and upper and lower shoulders extending around the sidewall portion to define a label region therebetween, the upper and lower shoulders having side portions and end portions corresponding respectively to the side wall portions and end wall portions of the sidewall portion.

10. The combination of the lid and container base of claim 9, wherein the upper shoulder has a saddle-shaped configuration with intermediate high portions on the end portions thereof and intermediate low portions on side portions thereof; and the free edge of the skirt portion has a saddle-shaped configuration complementary to the configuration of the upper shoulder with intermediate high portions on the end edge portions thereof and intermediate low portions on the side edge portions thereof.

11. The combination of the lid and container base of claim 10, wherein the lower shoulder has a saddle-shaped configuration generally mirrored to the configuration of the upper shoulder about a horizontal plane through the container base with intermediate low portions on the end portions thereof and intermediate high portions on the side portions thereof.

12. The combination of the lid and container base of claim 9, wherein the bottom wall portion is configured to fit within the generally planar label region of the top wall portion of the lid between the raised ribs when the container base is stacked onto the lid, the raised ribs being configured to engage the container base sidewall portion to restrict rotation of the container base.

13. The combination of the lid and container base of claim 9, wherein the container base further comprises a lip extending outwardly from a top edge portion of the sidewall portion, the lip having a track-shaped footprint with linear side regions, the linear side regions configured to provide larger engagement surfaces for conveyance machinery to maintain orientation as compared to rounded side regions.

14. The combination of the lid and container base of claim 9, wherein the container base further comprises a plurality of vertical ribs extending from the upper shoulder to the peripheral rim thereof, the vertical ribs providing support surfaces inward of the peripheral rim, the support surfaces of the vertical ribs configured to minimize telescoping of a nested second container base under stacking loads.

15. The combination of the lid and container base of claim 14 in combination with a foil cover sealed to the container base, wherein the plurality of vertical ribs include a chamfered upper surface configured to reduce impact on the foil cover when the foil cover is pulled inward with cooling of hot contents within the container base.

16. The combination of the lid and container base of claim 9, wherein the container base is configured to be nested together in a stack of the container bases, wherein the upper shoulder of a first container base is configured to rest on the peripheral rim of a second container base when nested therein; and the upper shoulder is curvilinear so that vent portions of the upper shoulder of the first container base do not rest on the peripheral rim of the second container base when nested therein, the vent portions configured to provide a venting pathway between the first and second containers when nested together.

17. The combination of the lid and container base of claim 16, wherein first container further comprises a label secured to the sidewall portion thereof, the label comprising a mark that is visible through at least one of the vent portions when the first and second containers are nested together to provide a visual indication of alignment of the container base.

18. The lid of claim 1, wherein the two or more raised ribs do not intersect the raised perimeter.

19. The lid of claim 1, wherein the raised perimeter completely surrounds the two or more raised ribs.

20. An oval container lid comprising:

a top wall portion with arcuate ribs configured to restrict rotation of a container base stacked on the top wall portion and between the arcuate ribs; and a skirt depending generally downwardly from an outer edge of the top wall portion and configured to removably secure to a container base;

the arcuate ribs being entirely spaced from the outer edge of the top wall portion and located interiorly relative to the outer edge of the top wall portion, each of the arcuate ribs having a first arcuate side and a second arcuate side intersecting the first arcuate side and located interiorly relative to the first arcuate side, the second arcuate sides of the arcuate ribs facing each other and defining a generally oval-shaped label region therebetween, the arcuate ribs increasing the rigidity of the top wall portion of the lid as compared to a lid without ribs;

wherein the top wall portion further comprises a raised peripheral region, the oval container lid being configured to rest in a downward orientation on a plurality of points or portions of stability provided by at least one of the arcuate ribs and the raised peripheral region;

wherein the oval container lid is in combination with a container base and a foil cover, the foil cover being sealed across an open top of the container base and the oval container lid being secured to the container base over the foil cover, the oval container lid further comprising a plurality of braces extending along a bottom surface of the top wall portion to span across a bottom cavity of the raised peripheral region; and wherein an inward end portion of the plurality of braces is chamfered to minimize deformation of the foil cover with a stacking load being placed upon the oval container lid.

21. A container comprising:

a base having a bottom wall portion and a sidewall portion defining an interior;

a lid having a top wall portion and a skirt depending downwardly from edge portions of the top wall portion, the skirt configured to secure to the base sidewall portion to secure the lid to the base;

a plurality of ribs of the top wall portion having an arc configuration, the plurality of ribs being entirely spaced from the top wall portion edge portions and located interiorly relative to the top wall portion edge portions, each of the plurality of ribs having a first arcuate side and a second arcuate side intersecting the first arcuate side and located interiorly relative to the first arcuate side, the second arcuate sides of the plurality of ribs facing each other and defining a generally oval-shaped label region therebetween, the plurality of ribs increasing the rigidity of the lid top wall portion as compared to a lid without ribs; and four or more spanning braces adjacent a bottom surface of the top wall portion, the spanning braces including transverse wall portions spanning across cavities created by the ribs on the bottom surface of the top wall portion, the transverse wall portions preventing the ribs from spreading apart as a result of stacking loads being placed on the lid;

wherein inward end portions of the spanning braces are chamfered, the spanning braces configured to deflect downwardly with deflection of the top wall portion under a stacking load such that the chamfered end portions minimize contact of the spanning braces with any material spanning beneath the lid.

* * * * *